US006834703B2

(12) United States Patent
Pacholke et al.

(10) Patent No.: US 6,834,703 B2
(45) Date of Patent: Dec. 28, 2004

(54) FLOATING PIVOT MOUNT FOR A FOLDING PANEL

(75) Inventors: Glen Douglas Pacholke, Eatons Hill (AU); Helmut Schmerbeck, Park Ridge (AU)

(73) Assignee: Centor Products Pty. Ltd. (AT)

( * ) Notice: Subject to any disclaimer, the term of this patent is extended or adjusted under 35 U.S.C. 154(b) by 0 days.

(21) Appl. No.: 10/437,770

(22) Filed: May 13, 2003

(65) Prior Publication Data

US 2003/0217821 A1 Nov. 27, 2003

(30) Foreign Application Priority Data

May 14, 2002 (AU) ..... PS 2311

(51) Int. Cl.[7] ..... E05D 15/26
(52) U.S. Cl. ..... 160/206
(58) Field of Search ..... 160/206, 199, 160/213; 16/235, 255, 364

(56) References Cited

U.S. PATENT DOCUMENTS 2,987,756 A * 6/1961 Mcferrell ..... 16/245
3,019,836 A * 2/1962 Leigh ..... 160/199
3,146,486 A * 9/1964 Hoffman ..... 16/242
3,172,146 A * 3/1965 Dickinson et al. ..... 16/245
3,251,090 A * 5/1966 Fergison ..... 16/238
3,391,723 A * 7/1968 Kirby ..... 160/206
3,554,267 A * 1/1971 Brinker ..... 160/118
3,866,658 A * 2/1975 Smith ..... 160/206

* cited by examiner

*Primary Examiner*—David Purol
(74) *Attorney, Agent, or Firm*—Wells St. John P.S.

(57) ABSTRACT

A variable pivot mount 11 is used to adjustably mount a door or window panel to a jamb. The pivot mount has a hinge pin 12 defining the pivot axis of the panel, and an arm 19 extending transversely to the hinge pin 12. The arm 19 locates in a socket 27 mounted to the jamb, and is axially slidable therein to accommodate lateral displacement of the hinge axis, e.g. due to out-of-square movements of the panel. The arm 19 may be biased to a rest position. The pivot mount can also be used as a floating intermediate hinge mount 40 for a door or window panel 41.

13 Claims, 5 Drawing Sheets

FLOATING PIVOT MOUNT FOR A FOLDING PANEL

This invention relates to a pivot mount for adjustably mounting a pivoting panel to a jamb. The panel is typically the first panel (i.e. the panel nearest the jamb) of a folding door, window or similar closure. In particular, the invention is directed to a "floating" hinge mount for a folding window, which can compensate for any out-of-square movement of the supported window panel.

Throughout the specification, where the context permits, the term "panel" is intended to include a window, door, shutter, screen or similar closure member used in a building, of a generally planar configuration mounted in an upright orientation and pivotable about a vertical pivot axis. The invention will be described with particular reference to pivot or hinge mounts for the first panel of a series of hinged window panels in a folding window, although it is not limited thereto.

BACKGROUND ART

A folding window may have several hinged panels, possibly up to eight or more, which fold open. Adjacent panels are hinged together to pivot about an intermediate vertical axis, and are suspended from a carriage which travels along a track. A carrier hinge, such as that described in Australian patent 726943, may be used to suspend a pair of adjacent hinged panels from the track while permitting the panels to travel along the track and pivot about a vertical axis.

In known folding windows, the first panel is typically suspended at its top proximal end (i.e. the end nearest the jamb) from the track by a hanger. The bottom proximal end of the end panel may have a pivot pin rotatable in a socket formed in the windowsill. Alternatively, the bottom end of the panel may be supported on a fixed pivot mount.

Due to building movement, or other loss of adjustment in the hanger and/or next carrier as a result of repeated opening and closing of the folding window, the end panel may come "out of square", putting added pressure on the bottom pivot pin. Excessive misalignment may result in sticking of the end panel.

Although it is known to use an adjustable bottom pivot mount (such as that described in Australian patent no. 739178) to adjust the end panel, the adjustable pivot mount must be adjusted at regular intervals to compensate for subsequent out-of-level movements between the end hanger and the next carrier. Many property owners neglect to make such adjustments.

Tall folding end panels may have an intermediate pivot or hinge located between the top and bottom hinges. If the intermediate hinge is not fixed precisely in alignment with the top and bottom hinges, it may cause "sticking" of the door, or warping. The fixed mounting of the intermediate hinge to the jamb also does not accommodate any subsequent "out of square" movements of the panel. Although adjustable hinge mounts are known, they may be adjusted regularly to compensate for dynamic variations in the panel alignment.

It is an object of this invention to provide an improved pivot mount for a panel which overcomes or ameliorates one or more of the above described disadvantages, or which at least provides the consumer with a useful choice.

SUMMARY OF THE INVENTION

In one broad form, the invention provides a folding panel assembly having a plurality of hinged panels suspended in an opening within a frame, the frame including a jamb, and a pivot mount for adjustably mounting an end panel of the hinged panels to the jamb, the pivot mount comprising a pivot pin member to which an edge portion of the end panel is pivotally mounted, the pivot pin member defining a pivot axis of the end panel, a mounting member fixed to the jamb, and an arm extending between the pivot pin member and the mounting member, transversely to the pivot axis, wherein the arm is movable along its axis relative to at least one of the pivot pin member and the mounting member to accommodate transverse movement of the pivot axis parallel to the opening, but constrained against movement relative to the pivot pin member and the mounting member in a direction transverse to the arm to thereby prevent transverse movement of the pivot axis perpendicularly to the opening.

In one embodiment, a hinge leaf is fixed to an edge portion of the panel near the bottom of the panel, the hinge leaf having a knuckle portion with an axial bore therein. The pivot pin member has a base portion and a pivot pin extending upwardly from the base portion and received in the axial bore. The base portion also has a bore extending transversely to the pivot axis, the arm having its other end located in the bore in the base portion.

In another embodiment, the pivot pin member comprises a first hinge leaf having a knuckle portion with a first axial bore therein. The assembly further comprises a second hinge leaf fixed to an edge portion of the panel at an intermediate height, the second hinge leaf having a knuckle portion with a second axial bore therein aligned with the first axial bore. A hinge pin is located in the aligned axial bores to form a hinge for the end panel. The mounting member is a socket member fixed to the jamb, and has a bore therein. The arm has one end connected to the first hinge leaf and projects therefrom transversely to the hinge pin. Its other end is slidingly received in the bore of the socket member, so that the hinge is moveable relative to the socket member in the direction of the arm. The arm has a cross section which is shaped and dimensioned for a close sliding fit in the bore of the socket member, and is constrained to be moveable relative to the socket member only along the axis of the arm, to thereby prevent movement of the hinge in a direction transverse to the arm.

Biasing means may be provided within the bore for biasing the arm axially to a rest position. The biasing means may comprise coil springs located around the arm in the bore, on opposite sides of a collar, to bias the arm axially to the rest position.

In another form, the invention provides a pivot mount for adjustably mounting a panel to a jamb, the pivot mount comprising a pivot pin member to which an edge portion of the end panel is pivotally mounted in use, the pivot pin member defining a pivot axis about which the end panel can pivot, a mounting member adapted to be fixed to the jamb, and an arm extending between the pivot pin member and the mounting member, transversely to the pivot axis, wherein the arm is movable along its axis relative to at least one of the pivot pin member and the mounting member to accommodate transverse movement of the pivot axis, but constrained against movement relative to the pivot pin member and the mounting member in a direction transverse to the arm.

Typically, the mounting member is a socket member having a bore therein, and the arm has one end received in the bore and moveable axially therein, and its other end connected to the pivot pin member.

The bore and arm may rely on friction to dampen or stiffen the movement of the plunger arm into and out of the bore, thereby eliminating any loose feel (although an undamped system would also serve the general function, though with a less desirable feel). The friction may be obtained in any number of ways including oil damping, friction washer or the like.

In order that the invention may be more readily understood and put into practice, a preferred embodiment thereof will now be described by way of example, with reference to the accompanying drawings.

DESCRIPTION OF PREFERRED EMBODIMENT

Figure 1:
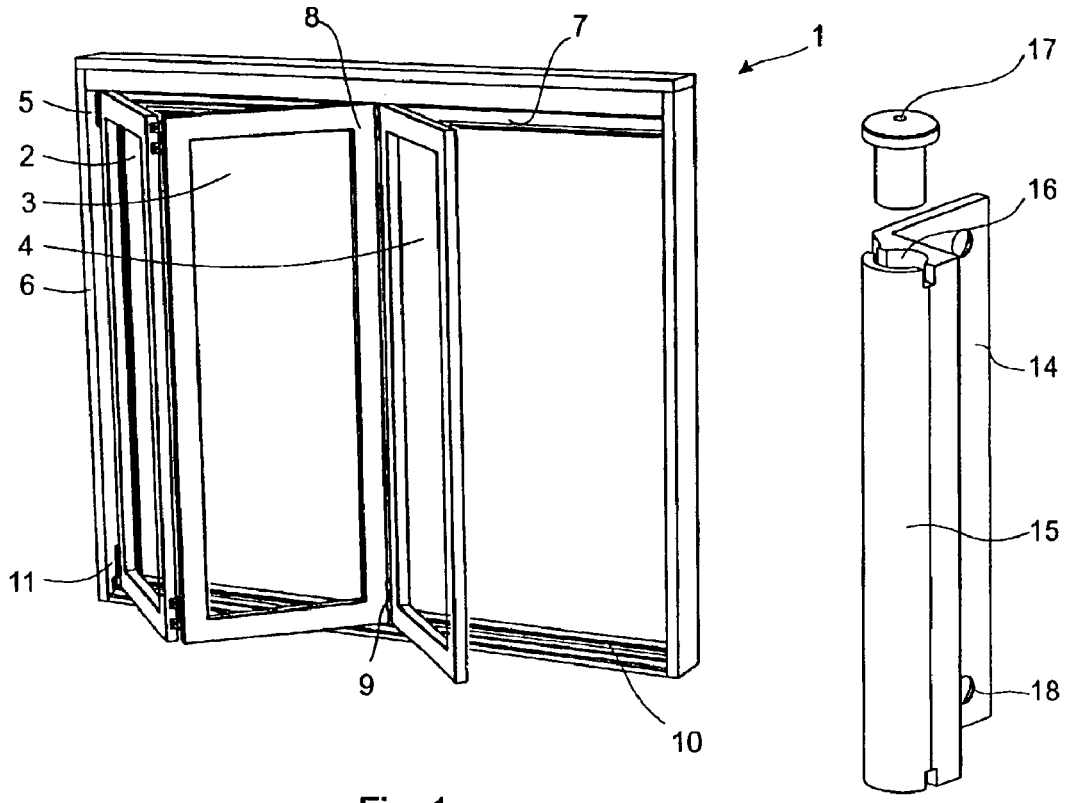
FIG. 1 is a perspective view of a folding window using a pivot mount according to one embodiment of the invention.

FIG. 1 illustrates a folding window 1 which includes three hinged window panels 2, 3, 4. The panels 2, 3, 4 may be glazed, solid, shuttered or louvred. The first or end panel 2 has a hanger 5 attached to its top proximal end (i.e. the top end nearest the jamb 6) which is used to suspend the panel 2 from an overhead track 7. The other two panels 3, 4 are suspended from the track 7 by a carrier hinge assembly 8, such as the type described in Australian patent no. 726943. A hinge 9 is located at the bottom of the panels 3, 4, and is fixed to opposed edges of the panels. The hinge 9 may have a hinge pin which protrudes below the panels 3, 4 and locates in a guide channel 10 in the windowsill or is otherwise restrained, or may be left unrestrained. For example, the hinge 9 may have a hinge pin protruding from the bottom thereof with a roller mounted on the protruding pin. The roller may locate in a channel, or abut against an angle section or against a sill step.

According to one embodiment of this invention, a variable pivot mount 11 is used to mount the bottom portion of the end panel 2 to the jamb 6. The hanger 5 and bottom pivot mount 11 permit the end panel 2 to pivot about a vertical axis defined by the hanger 5 and the bottom pivot 11.

Figure 2:
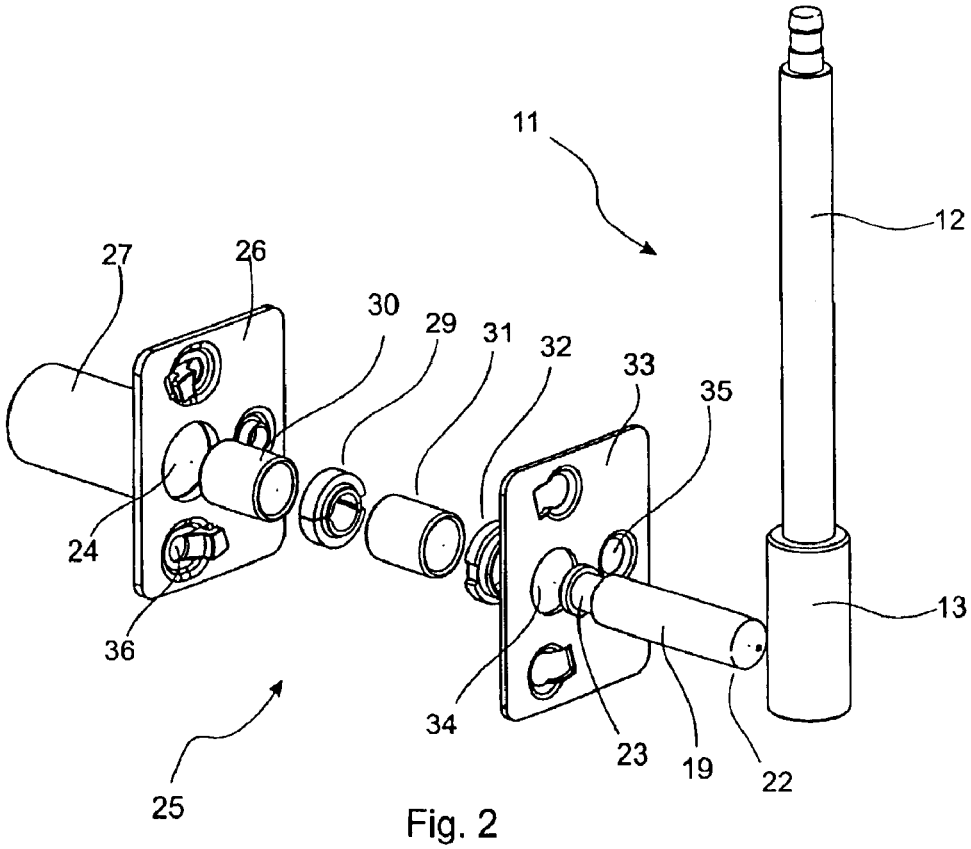
FIG. 2 is an exploded view of the pivot mount used in the window assembly of FIG. 1.
Figure 3:
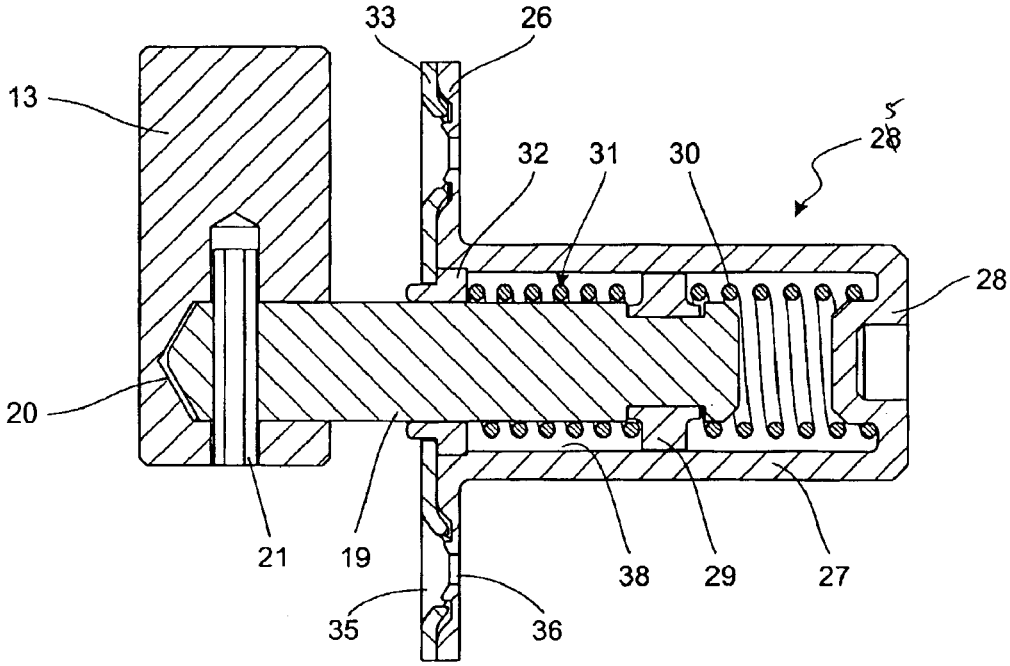
FIG. 3 is a partial sectional elevation of the assembled pivot mount of FIG. 2.
Figure 4:
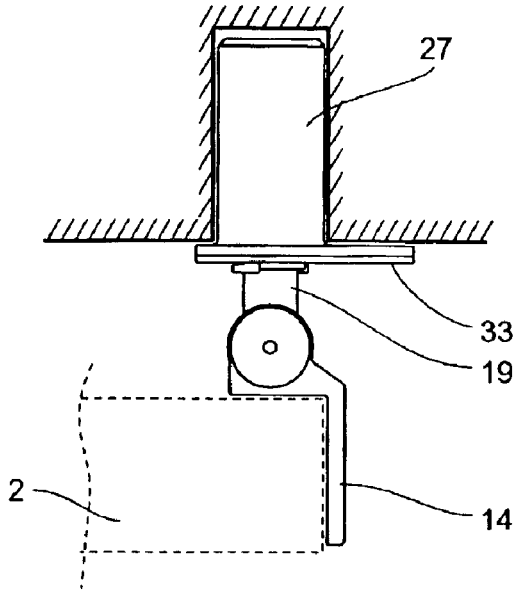
FIG. 4 is a schematic plan view of the pivot mount of FIG. 2 when the window is in its opened position.
Figure 5:
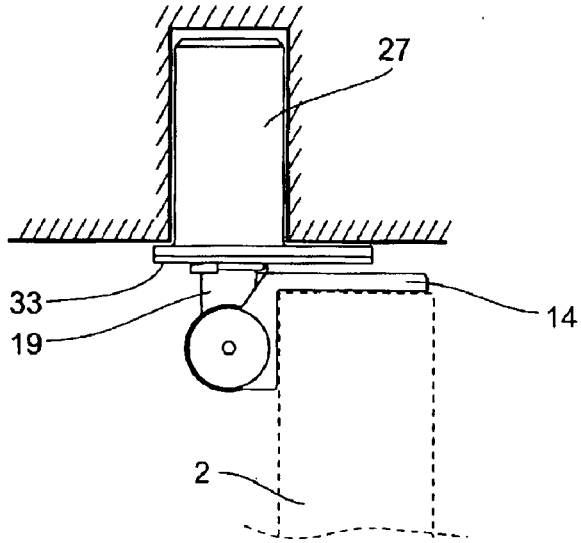
FIG. 5 is a schematic plan view of the pivot mount of FIG. 2 when the window is in its closed position.
Figure 6:
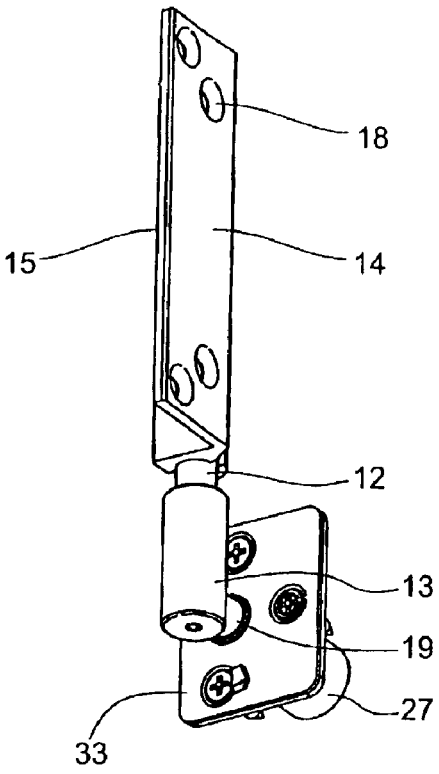
FIG. 6 is a perspective view of the pivot mount of FIG. 2 when the window is in its opened position.
Figure 7:
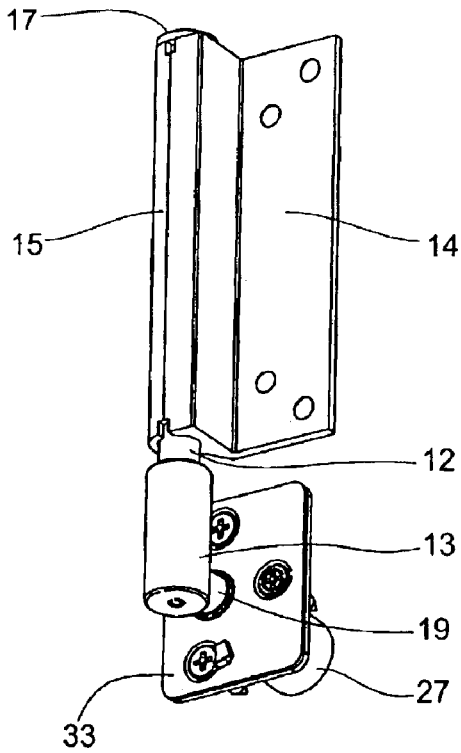
FIG. 7 is a perspective view of the pivot mount of FIG. 2 when the window is in its closed position.
Figure 11:
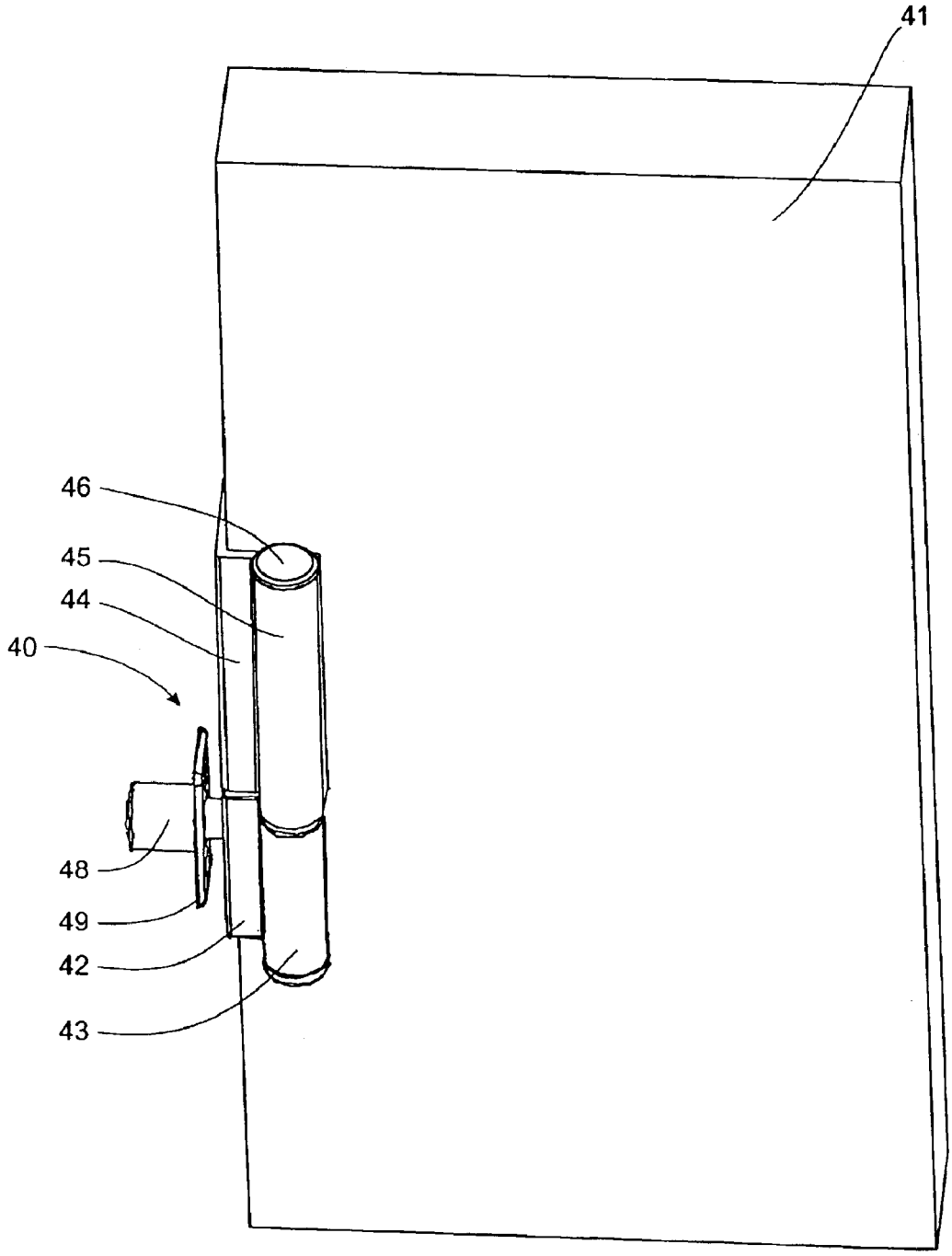
FIG. 11 is a schematic perspective view of a floating hinge mount for a folding panel, according to another embodiment of this invention.
Figure 14:
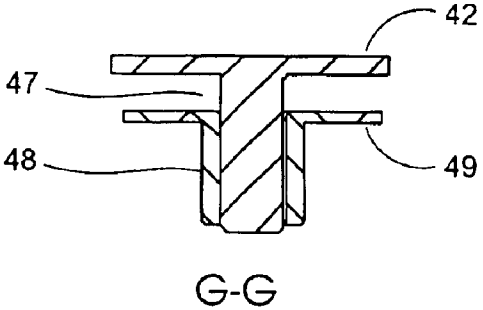
FIG. 14 is a sectional view along G—G of FIG. 13.
Figure 13:
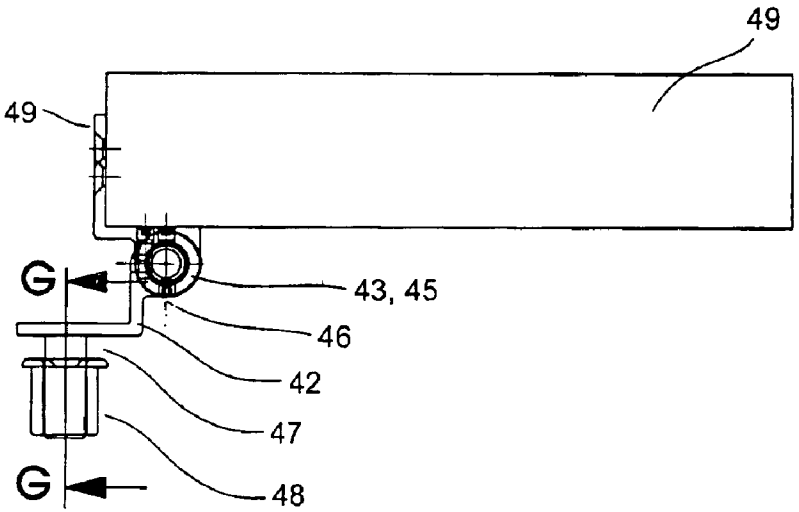
FIG. 13 is a plan view of the hinge mount of FIG. 11 with the panel in an open position.
Figure 12:
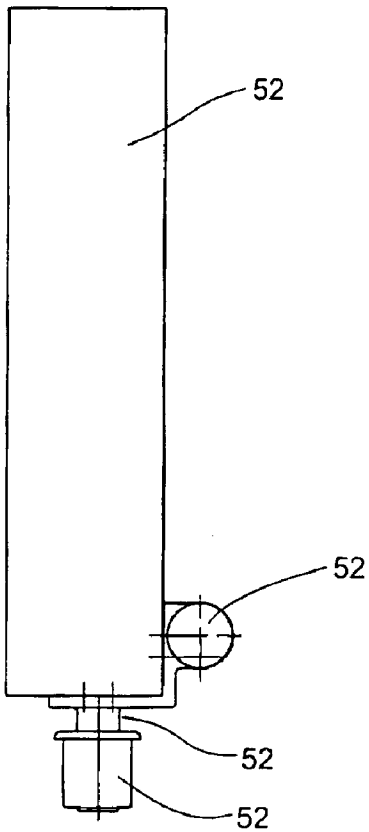
FIG. 12 is a plan view of the hinge mount of FIG. 11, with the panel in a closed position.

The bottom pivot mount 11, hereafter referred to simply as the "bottom pivot", is shown in more detail in FIGS. 2–7 and comprises a base portion 13 having a pivot pin 12. The pivot pin 12 serves as a hinge pin (and is hereafter referred to simply as the hinge pin). A hinge leaf 14 having a knuckle portion 15 is pivotally mounted on the hinge pin 12 to form a hinge. The knuckle portion 15 has a bore 16 therethrough which is dimensioned to receive the hinge pin 12 in a close sliding fit. A cap 17 may suitably be provided on the bore 16. Screw holes 18 are provided in the hinge leaf to enable it to be screwed to the edge face of panel 2, as shown in FIGS. 4 and 5. (For clarity, the panel 2 is omitted from FIGS. 6–10).

An arm 19 has a distal end which locates in a radial bore 20 in the base 13 of the hinge pin 12 (FIG. 3), so that the arm 19 extends transversely to the hinge pin 12, and hence perpendicularly to the hinge axis of the panel 2. In use, the hinge pin 12 is normally orientated vertically, and the arm 19 extends horizontally. A roll pin 21 is inserted in the underside of the base 13 to retain the arm 19 in engagement with the base 13, as illustrated in FIG. 3. The roll pin 21 engages with a neck portion 22 on the distal end of the arm 19 to retain the arm 19 in the base 13.

However, it is to be understood that any other suitable fixing arrangement between the arm 19 and the base 13 may be used. For example, the hinge pin 12, base 13 and arm 19 may be formed as a unipartite member.

The other (proximal) end of arm 19 has a neck portion 23 of reduced diameter which locates in a socket member 25 shown in more detail in FIGS. 2 and 3. The socket member 25 (hereafter referred to simply as the wall mount) comprises an inner wall plate 26 having a tubular portion 27 with a blind end 28. The bore of the tubular portion 27 communicates with an opening 24 in the plate 26. The wall plate 26 is mounted to the jamb 6 (or other suitable wall portion), and the tubular portion 27 provides a horizontal bore or socket in which the distal end of arm 19 locates.

A two-part collar 29 is snap fitted around the neck 23 of arm 19. When assembling the wall mount 25, an inner coil spring 30 is first inserted in the tubular portion 27, and then the arm 19 with collar 29 fitted thereto is inserted into the tubular portion 27 to compress the spring 30 against the end 28. An outer coil spring 31 is placed around the arm 19, on the opposite side of the collar 29 to the innerspring 30. An outer collar or seal 32 is then placed around the arm 19 to retain the outer spring 31 on the arm 19. (The collar 29, spring 31 and collar seal 32 are typically pre-assembled on the arm 19 before insertion into the tubular portion 27). An outer wall plate 33 is then placed over the arm 19. The outer wall plate 33 has an aperture dimensioned to receive the collar seal 32 in the snug fit.

The outer wall plate 33 has screw holes 35 therein which align with corresponding screw holes 36 in the inner wall plate 26, to permit both plates to be fixed to the jamb 6, or similar wall portion.

As can be seen from FIG. 3, the abovedescribed wall mount provides a captive mounting arrangement for the arm 19, yet permits the arm 19 to move axially relative to its socket in the tubular portion 27. Furthermore, the arm 19 is spring loaded, and biased to a central or rest position. Although springs 30, 31 have been used as the biasing devices in the illustrated embodiment, other suitable biasing elements or friction damping devices may be used.

Figures 8, 9, 10:
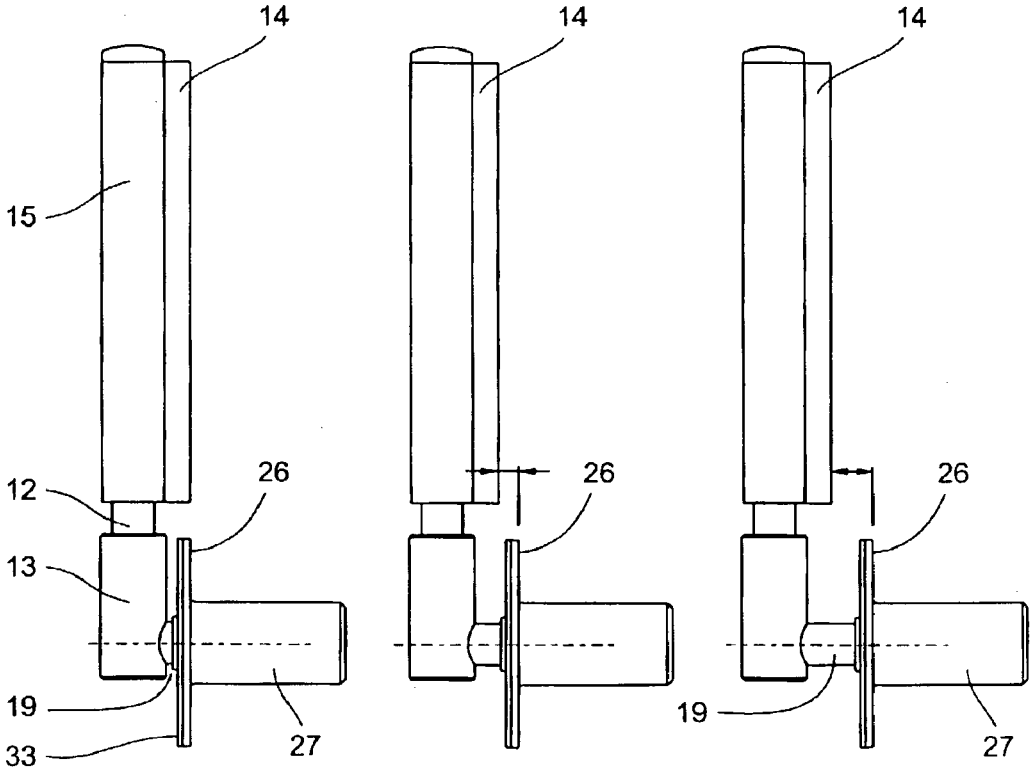
FIGS. 8 to 10 are elevational views of the pivot mount of FIG. 2, illustrating variable spacing between the pivot pin and wall mount.

The pivot mount of the illustrated embodiment permits the hinge pin to "float" in and out of the window jamb 6 (as illustrated in FIGS. 8–10) to compensate for any out-of-level movement between the top pivot or hanger 5 and the next carrier 8. Moreover, the springs 30, 31 provide a resilient mounting arrangement for the hinge pin 12, and bias the hinge pin to a rest position. The arm 19 can rotate about its longitudinal axis, and hence the hinge pin 12 is able to pivot about the longitudinal axis of the arm 19 to a small degree. The above described pivot mount can thereby accommodate small movements of the hinge axis of the panel 2 about orthogonal horizontal axes.

It is to be noted that since the arm 19 is constrained against movement relative to the base 13 and socket 25 in a direction transverse to its axis, the pivot mount supports the panel against wind loads and other forces acting perpendicularly to the face of the panel. That is, wind loads and such other forces are transmitted by the pivot mount to the jamb.

The pivot mount may also be used in inverted orientation as a top pivot for a panel which is supported on its bottom pivot.

In an alternative embodiment, the pin 19 is fixed perpendicularly to the plate 33, and the plate 33 is flush-mounted to the jamb. The pin 19 is received in a radial bore in the base 13 and can freely slide therein (with or without biasing). The base 13 can then move horizontally relatively to the jamb to accommodate transverse movement of the hinge axis.

This invention can also be embodied as a floating intermediate hinge to a jamb for a tall door or window panel (with adjustable top and bottom pivot mounts if required), to give the panel lateral support against bowing or deflection due to wind loads, etc. yet accommodate displacement of the hinge axis.

As shown in FIGS. 11–14, an intermediate hinge 40 is fixed to an edge of a door or window panel 41, between top and bottom pivot mounts. (Only the portion of the panel 41 adjacent the intermediate hinge 40 is shown, and the top and bottom pivots are omitted from the drawings for clarity).

The intermediate hinge 40 comprises a pivot pin member which is a modified hinge leaf 42 having a knuckle portion 43. The intermediate hinge also includes a hinge leaf 44 which, in use, is fixed to an edge portion of the panel 41. The hinge leaf 44 has a knuckle portion 45. A hinge pin 46 locates in registered bores in the knuckle portions 43, 45 to define the hinge axis of the intermediate hinge.

The hinge leaf 42 has a short projecting arm or pin 47 fixed thereto, which extends transversely to the hinge axis.

The intermediate hinge mount also includes a socket 48 which, in use, is fixed in the jamb (not shown) to which the panel 41 is mounted. The socket 48 is suitably provided with outer flange portions 49 to permit the socket 48 to be fixed to the jamb surface.

In use, the pin 47 locates in the bore of the socket 48. There is sufficient clearance between the pin 47 and the bore to permit the pin 47 to slide freely within the socket 48, but without excessive slapping.

As the pin 47 is moveable relative to the socket 48, and hence the jamb, the intermediate hinge can accommodate out-of-square movements which result in a lateral or transverse shifting of the hinge axis in the direction of the pin axis. However, the intermediate hinge mount still provides lateral support against bowing or deflection due to wind loads or other forces acting perpendicularly to the plane of the panel 41. That is, forces acting transversely to the plane of the panel 41 will be transferred by the pin 47 to the jamb in which the socket 48 is mounted.

What is claimed is:

1. A folding panel assembly having a plurality of hinged panels suspended in an opening within a frame including a jamb, and a pivot mount for adjustably mounting an end panel of the hinged panels to the jamb, the pivot mount comprising:

a pivot pin member to which an edge portion of the end panel is pivotally mounted, the pivot pin member defining a pivot axis of the end panel;

a mounting member fixed to the jamb, the mounting member being a socket member having a bore therein; and an arm extending between the pivot pin member and the mounting member, transversely to the pivot axis, the arm having one end received in the bore of the mounting member and moveable axially therein, and its other end connected to the pivot pin member, wherein the arm is movable along its axis relative to the mounting member to accommodate transverse movement of the pivot axis parallel to the opening, but constrained against movement relative to the pivot pin member and the mounting member in a direction transverse to the arm to thereby prevent transverse movement of the pivot axis perpendicularly to the opening.

2. A folding panel assembly as claimed in claim 1, further comprising biasing means within the bore for biasing the arm axially to a rest position.

3. A folding panel assembly as claimed in claim 2, further comprising a collar fitted to the arm, and wherein the biasing means comprises coil springs located around the arm in the bore, on opposite sides of the collar, to bias the arm axially to the rest position.

4. A folding panel assembly as claimed in claim 1, further comprising a hinge leaf fixed to an edge portion of the panel near the bottom of the panel, the hinge leaf having a knuckle portion with an axial bore therein, and wherein the pivot pin member has a base portion and a pivot pin extending upwardly from the base portion and received in the axial bore, the base portion having a bore extending transversely to the pivot axis, the arm having its other end located in the bore in the base portion.

5. A folding panel assembly as claimed in claim 1, wherein the pivot pin member comprises a first hinge leaf having a knuckle portion with a first axial bore therein, the assembly further comprising a second hinge leaf fixed to an edge portion of the panel at an intermediate height, the second hinge leaf having a knuckle portion with a second axial bore therein aligned with the first axial bore, a hinge pin being located in the aligned axial bores to form a hinge for the end panel.

6. A pivot mount for adjustably mounting a panel to a jamb, the pivot mount comprising:

a pivot pin member to which an edge portion of the end panel is pivotally mounted in use, the pivot pin member defining a pivot axis about which the end panel can pivot;

a mounting member adapted to be fixed to the jamb, the mounting member being a socket member having a bore therein; and an arm extending between the pivot pin member and the mounting member, transversely to the pivot axis, the arm having one end received in the bore and moveable axially therein, and its other end connected to the pivot pin member, wherein the arm is movable along its axis relative to the mounting member to accommodate transverse movement of the pivot axis, but constrained against movement relative to the pivot pin member and the mounting member in a direction transverse to the arm.

7. A pivot mount as claimed in claim 6, further comprising biasing means for biasing the arm axially to a rest position within the bore.

8. A pivot mount as claimed in claim 7, wherein said one end of the arm is captively received in the bore of the socket member, the pivot mount further comprising a collar fitted adjacent to said one end of the arm, and wherein the biasing means comprises coil springs located around the arm in the bore, on opposite sides of the collar, to bias the arm axially to the rest position.

9. A pivot mount as claimed in claim 6, further comprising a hinge leaf adapted to be fixed to an edge portion of the panel, the hinge leaf having a knuckle portion with an axial bore therein, and wherein the pivot pin member has a base portion and a pivot pin extending upwardly from the base portion and received in the axial bore, the base portion having a bore extending transversely to the pivot axis, the arm having its other end located in the bore in the base portion.

10. A pivot mount as claimed in claim 6, wherein the pivot pin member comprises a first hinge leaf having a knuckle portion with a first axial bore therein, the mount further comprising a second hinge leaf adapted to be fixed to an edge portion of the panel, the second hinge leaf having a knuckle portion with a second axial bore therein aligned with the first axial bore, and a hinge pin located in the aligned axial bores to form a hinge.

11. A mount assembly for adjustably mounting a hinged panel to a jamb, the mount assembly comprising a first hinge leaf adapted to be fixed to an edge portion of the panel, the first hinge leaf having a knuckle portion with a first bore therein, a second hinge leaf having a knuckle portion with a second axial bore therein aligned with the first axial bore, a hinge pin located in the aligned axial bores to form a hinge, a socket member adapted to be fixed to the jamb, the socket member having a bore therein, and an arm having one end connected to the second hinge leaf and projecting therefrom transversely to the hinge pin, and its other end slidingly received in the bore of the socket member, whereby the hinge is moveable relative to the socket member in the direction of the arm.

12. A mount assembly as claimed in claim 11, wherein the arm is constrained to be moveable relative to the socket member only along the axis of the bore of the socket member, to thereby prevent movement of the hinge in a direction transverse to the axis of the bore of the socket.

13. A mount assembly as claimed in claim 11, wherein the arm has a cross section which is shaped and dimensioned for a close sliding fit in the bore of the socket member.

* * * * *

US006834703C1

(12) EX PARTE REEXAMINATION CERTIFICATE (9439th)

United States Patent

Pacholke et al.

(10) Number: US 6,834,703 C1

(45) Certificate Issued: Dec. 14, 2012

(54) FLOATING PIVOT MOUNT FOR A FOLDING PANEL

(75) Inventors: Glen Douglas Pacholke, Eatons Hill (AU); Helmut Schmerbeck, Park Ridge (AU)

(73) Assignee: Centor Australia Pty Ltd, Eagle Farm, Queensland (AU)

Reexamination Request:
No. 90/012,159, Feb. 22, 2012

Reexamination Certificate for:

| | |
|---|---|
| Patent No.: | **6,834,703** |
| Issued: | **Dec. 28, 2004** |
| Appl. No.: | **10/437,770** |
| Filed: | **May 13, 2003** |

(30) Foreign Application Priority Data

May 14, 2002 (AU) ..... PS 2311

(51) Int. Cl.
*E05D 15/26* (2006.01)

(52) U.S. Cl. ..... 160/206

(58) Field of Classification Search ..... None
See application file for complete search history.

(56) References Cited

To view the complete listing of prior art documents cited during the proceeding for Reexamination Control Number 90/012,159, please refer to the USPTO's public Patent Application Information Retrieval (PAIR) system under the Display References tab.

*Primary Examiner* — Jeffrey R. Jastrzab

(57) ABSTRACT

A variable pivot mount 11 is used to adjustably mount a door or window panel to a jamb. The pivot mount has a hinge pin 12 defining the pivot axis of the panel, and an arm 19 extending transversely to the hinge pin 12. The arm 19 locates in a socket 27 mounted to the jamb, and is axially slidable therein to accommodate lateral displacement of the hinge axis, e.g. due to out-of-square movements of the panel. The arm 19 may be biased to a rest position. The pivot mount can also be used as a floating intermediate hinge mount 40 for a door or window panel 41.

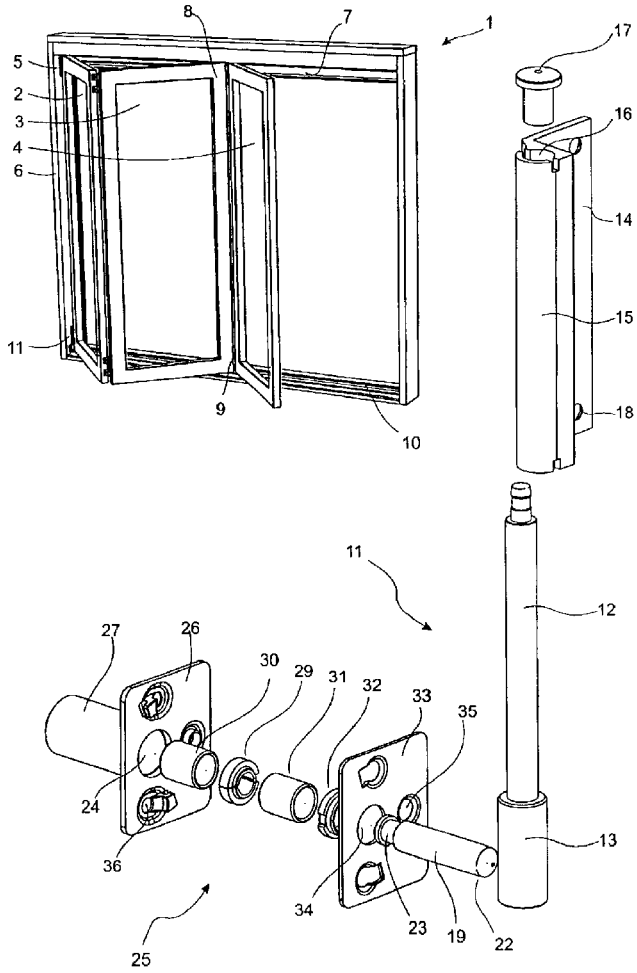

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6 and 11 are determined to be patentable as amended.

Claims 2-5, 7-10 and 12-13, dependent on an amended claim, are determined to be patentable.

New claims 14-21 are added and determined to be patentable.

1. A folding panel assembly having a plurality of hinged panels suspended in an opening within a frame including a jamb, and a pivot mount for adjustably mounting an end panel of the hinged panels to the jamb, the pivot mount comprising:

a pivot pin member to which an edge portion of the end panel is pivotally mounted, the pivot pin member defining a pivot axis of the end panel;

a mounting member fixed to the jamb, the mounting member being a socket member having a bore therein; and an arm extending between the pivot pin member and the mounting member, transversely to the pivot axis, the arm having one end received in the bore of the mounting member and moveable axially therein, and its other end connected to the pivot pin member, wherein the arm is movable along its axis relative to the mounting member to accommodate transverse movement of the pivot axis parallel to the opening, but constrained against movement relative to the pivot pin member and the mounting member in a direction transverse to the arm to thereby prevent transverse movement of the pivot axis perpendicularly to the opening, *wherein the arm is a floating pin member within the bore of the socket member of the mounting member*.

6. A pivot mount for adjustably mounting a panel to a jamb, the pivot mount comprising:

a pivot pin member to which an edge portion of the end panel is pivotally mounted in use, the pivot pin member defining a pivot axis about which the end panel can pivot;

a mounting member adapted to be fixed to the jamb, the mounting member being a socket member having a bore therein; and an arm extending between the pivot pin member and the mounting member, transversely to the pivot axis, the arm having one end received in the bore and moveable axially therein, and its other end connected to the pivot pin member, wherein the arm is movable along its axis relative to the mounting member to accommodate transverse movement of the pivot axis, but constrained against movement relative to the pivot pin member and the mounting member in a direction transverse to the arm, *wherein the arm is a floating pin member within the bore of the socket member of the mounting member*.

11. A mount assembly for adjustably mounting a hinged panel to a jamb, the mount assembly comprising a first hinge leaf adapted to be fixed to an edge portion of the panel, the first hinge leaf having a knuckle portion with a first *axial* bore therein, a second hinge leave having a knuckle portion with a second axial bore therein aligned with the first axial bore, a [hinge] *pivot* pin *member* located in the aligned axial bores to form a hinge, a socket member adapted to be fixed to the jamb, the socket member having a bore therein, and an arm having one end connected to the second hinge leaf and projecting therefrom transversely to the [hinge] *pivot* pin *member*, and its other end slightly received in the bore of the socket member, whereby the hinge is moveable relative to the socket member in the direction of the arm.

*14. The mount assembly as claimed in claim 11, wherein the pivot pin member has a base portion and a pivot pin extending upwardly from the base portion and received in the axial bores, the base portion having a bore extending transversely to the pivot axis, the arm having its other end located in the bore in the base portion.*

*15. A folding panel assembly as claimed in claim 1 wherein the arm may also pivot along its longitudinal axis.*

*16. A pivot mount as claimed in claim 6, wherein the arm may also pivot along its longitudinal axis.*

*17. A mount assembly as claimed in claim 11, wherein the arm is a floating pin member within the bore of the socket member of the mounting member.*

*18. A mount assembly as claimed in claim 11, wherein the arm may also pivot along its longitudinal axis.*

*19. A folding panel assembly having a plurality of hinged panels suspended in an opening within a frame including a jamb, and a pivot mount for adjustably mounting an end panel of the hinged panels to the jamb, the pivot mount comprising:*

*a pivot pin member to which an edge portion of the end panel is pivotally mounted, the pivot pin member defining a pivot axis of the end panel;*

*a mounting member fixed to the jamb, the mounting member being a socket member having a bore therein;*

*an arm extending between the pivot pin member and the mounting member, transversely to the pivot axis, the arm having one end capitively received in the bore of the socket member and moveable axially therein, and its other end connected to the pivot pin member, wherein the arm is movable along its axis relative to the mounting member to accommodate transverse movement of the pivot axis parallel to the opening, but constrained against movement relative to the pivot pin member and the mounting member in a direction transverse to the arm to thereby prevent transverse movement of the pivot axis perpendicularly to the opening;*

*a collar fitted adjacent to said one end of the arm;*

*a biasing means within the bore for biasing the arm axially to a rest position, wherein the biasing means comprises coil springs located around the arm in the bore, on opposite sides of the collar, to bias the arm axially to the rest position; and*

*a hinge leaf fixed to an edge portion of the panel near the bottom of the panel, the hinge leaf having a knuckle portion with an axial bore therein, and wherein the pivot pin member has a base portion and a pivot pin extending upwardly from the base portion and received in the axial bore, the base portion having a bore extending trans-*

*versely to the pivot axis, the arm having its other end located in the bore in the base portion.*

*20. A folding panel assembly as claimed in claim 19, wherein the arm is a floating pin member within the bore of the socket member of the mounting member.*

*21. A pivot mount for adjustably mounting a panel to a jamb, the pivot mount comprising:*

*a pivot pin member to which an edge portion of the end panel is pivotally mounted in use, the pivot pin member defining a pivot axis about which the end panel can pivot, wherein the pivot pin member comprises a first hinge leaf having a knuckle portion with a first axial bore therein, the pivot mount further comprising a second hinge leaf adapted to be fixed to an edge portion of the panel, the second hinge leaf having a knuckle portion with a second axial bore therein aligned with the first axial bore, and a hinge pin located in the aligned axial bores to form a hinge;*

*a mounting member adapted to be fixed to the jamb, the mounting member being a socket member having a bore therein; and*

*an arm extending between the pivot pin member and the mounting member, transversely to the pivot axis, the arm having one end received in the bore and moveable axially therein, and its other end connected to the pivot pin member, wherein the arm is movable along its axis relative to the mounting member to accommodate transverse movement of the pivot axis, but constrained against movement relative to the pivot pin member and the mounting member in a direction transverse to the arm.*

* * * * *